United States Patent [19]

Giavarini

[11] Patent Number: 4,706,053

[45] Date of Patent: Nov. 10, 1987

[54] MICROWAVE METALLIC CAVITY

[75] Inventor: Andrea Giavarini, Milan, Italy

[73] Assignee: GTE Telecommunicazioni, S.p.A., Milan, Italy

[21] Appl. No.: 846,774

[22] Filed: Mar. 31, 1986

[30] Foreign Application Priority Data

Jul. 29, 1985 [IT] Italy ..... 21751 A/85

[51] Int. Cl.[4] ..... H01P 7/06; H01P 1/30

[52] U.S. Cl. ..... 333/229; 333/233; 333/235

[58] Field of Search ..... 333/227–235, 333/248, 208–212, 202

[56] References Cited

U.S. PATENT DOCUMENTS 3,414,847 12/1968 Johnson ..... 333/229
3,873,949 3/1975 Dorsi et al. ..... 333/229 X
4,057,772 11/1977 Basil, Jr. et al. ..... 333/229
4,156,860 5/1979 Atia et al. ..... 333/229
4,488,132 12/1984 Collins et al. ..... 333/230 X

*Primary Examiner*—Marvin L. Nussbaum
*Attorney, Agent, or Firm*—Jeffrey P. Morris

[57] ABSTRACT

A microwave metallic cavity, whose resonating frequency is stabilized versus operating temperature variations. Stabilization is achieved by implementing the cavity with a conical base having a thickness and a coefficient of linear expansion smaller than that of the cavity cylindrical body. In this way the volume enclosed by the conical base to in inverse ratio versus operating temperature variations, so as to compensate for the variation in volume of the cavity cylindrical body, which results in stabilization of the resonating frequency.

14 Claims, 3 Drawing Figures

MICROWAVE METALLIC CAVITY

DESCRIPTION

Figure 1:
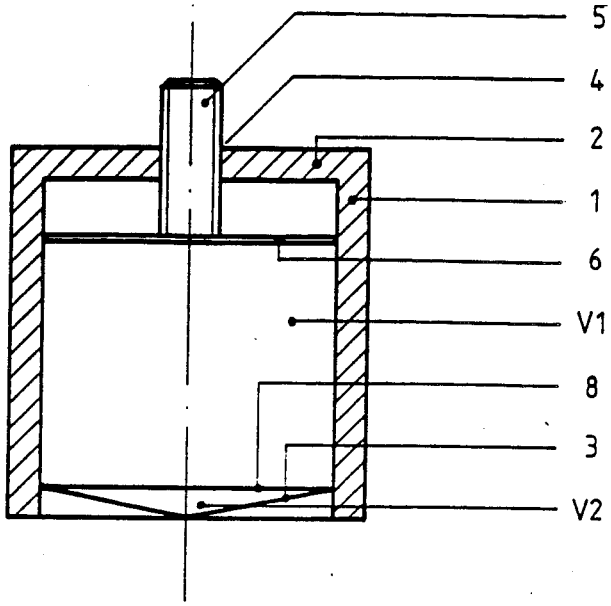

The present invention refers to a microwave metallic cavity comprising a hollow body, which encloses a first volume and a number of bases which determine its total volume and the resonating frequency, such first volume increasing as long as the operating temperature increases.

It is well known that the resonating frequency of a microwave resonating cavity depends on the volume of the same cavity and, more precisely, an increase in the volume of the cavity results in a decrease of the resonating frequency, whereas a decrease in the volume of the cavity results in an increase of the resonating frequency.

It is also well known tht in a metallic resonating cavity a temperature variation results in a variation of the volume and therefore of the resonating frequency. Precisely the resonating frequency varies in inverse ratio with respect to the operating temperature and to the coefficient of linear expansion of the material used to implement the cavity. This is to say that the higher the operating temperature and the coefficient of linear expansion of the material of the cavity, the lower is the resonating frequency of the metallic cavity.

It is also well known that the material most commonly used in manufacturing waveguide components is brass, which features a coefficient of linear expansion of $18\times10^{-6}[°C.]^{-1}$. By using such material at resonating frequencies of 15 to 20 GHz, a temperature increase of 25° C. results in a decrease of the resonating frequency of about 7 to 9 MHz.

It is also well known that, in order to compensate for the resonating frequency variations versus the operating temperature, materials featuring low values of coefficient of linear expansion (for instance invar whose coefficient of linear expansion is $1.5\times10^{-6}[°C.]^{-1}$) are used in the construction of microwave cavities, so as to reduce the variations in volume of the cavity versus temperature variations. However, the use of invar results in considerably higher production costs. As a matter of fact the material is instrinsically more expensive and working times are considerably longer, because of the higher difficulties encountered in machining invar with machine tools.

Therefore, purpose of the present invention is to overcome the said drawbacks and to disclose a microwave metallic cavity implemented with materials having a high value of coeffient of linear expansion are, easy and economical to machine with machine tools, and which presents a volume and consequently a resonating frequency stabilized versus operating temperature.

To achieve these purposes, the present invention refers to a microwave metallic cavity comprising a hollow body, which encloses a first volume, and a number of bases which determine its total volume and the resonating frequency, such first volume being increasing as long as operating temperature increases, characterised in that at least one of the bases is made up of a geometrical shape, which encloses a second volume, such second volume being decreasing as long as operating temperature increases.

Figure 2:
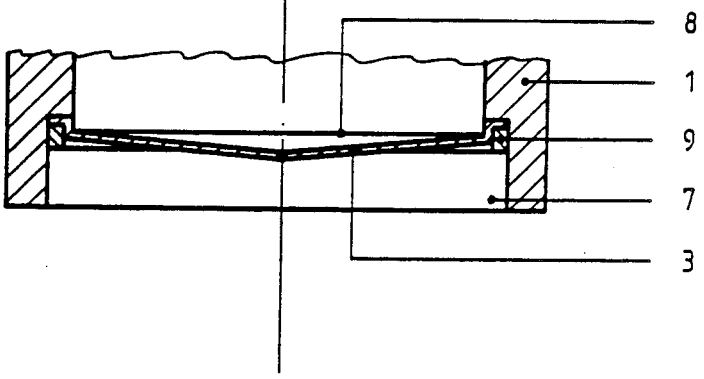
Figure 3:
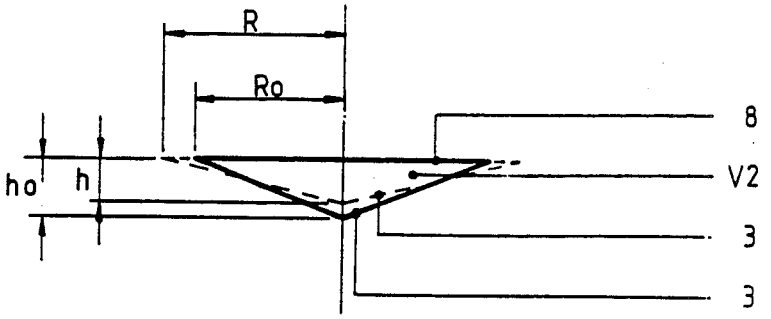

Further purposes and advantages of the present invention shall be clear from the following detailed description of a preferred embodiment and from the attached drawings given only as an example, but not limited thereto wherein:

FIG. 1 shows a cross section of a cylindrical metallic cavity according to the present invention, FIG. 2 shows a cross section of a constructive detail of the cylindrical metallic cavity of FIG. 1 and FIG. 3 shows a schematic detail of the cylindrical metallic cavity of FIG. 1.

With reference to FIGS. 1, 2 and 3, the metallic cavity shown therein is formed of a hollow cylindrical body 1, an upper base 2 and a lower base 3. The upper base 2 has a flat circular shape. The cylindrical body 1 and the upper base 2 of the cavity are made of brass, copper or aluminium having a thickness of 2 to 5 mm, and feature a coefficient of linear expansion $\alpha$. The upper base 2 has a threaded hole 4 in which an adjusting screw 5 is screwed in. A mobile base 6 also made of brass, copper or aluminium having a thickness of 1 to 2 mm is firmly connected to the end of the adjusting screw 5 which is inside the cavity. The lower base 3 of the cavity, according to the invention, has a conical shape, the vertex being faced to the outside of the cavity, and made of an iron-nickel alloy, for example invar, having a thickness of 0.1 to 0.4 mm and features a coefficient of linear expansion $\beta$, much less than $\alpha$. More precisely, the lower internal section of the cylindrical body 1 has a cylindrical groove 7, in which the conical base 3 is inserted, so as to identify a circular surface 8 which is common to the cylindrical body 1 and to the conical base 3. A retaining ring 9 is located above the peripheral section of the conical base 3. The retaining ring 9 and the peripheral section of the conical base 3 are then soldered onto the internal section of the cylindrical body 1 so as to form one body. The cylindrical body 1, the mobile base 6 and the circular surface 8 enclose a first volume "V1", whereas the circular surface 8 and the conical base 3 enclose a second volume "V2". The total volume of the cavity, therefore, results formed by the first volume "V1" due to the cylindrical body 1 of the cavity and from the second volume "V2" due to the conical base 3 of the cavity.

The required resonating frequency is obtained by moving the mobile base 6 by means of the adjusting screw 5 in order to obtain the right volume "V1+V2" of the cavity. At the reference temperature "To" the cylindrical body 1 of the cavity has a volume "V1o", whilst the conical base 3 has a radius "Ro" and a height "ho" and, therefore, a volume "V2o". The total volume of the cavity at the ambient temperature "To" is consequently "V1o+V2o". Any increase in operating temperature results in a thermal expansion of the cylindrical body 1 of the cavity and therefore in an increase in its volume, which becomes "V1". The conical base 3, as already said, has the following characteristics: is soldered to the cylindrical body 1, has a thickness much smaller than the thickness of the cylindrical body 1 and features a coefficient of linear expansion, $\beta$, which is much lower than the coefficient of linear expansion, $\alpha$, of the cylindrical body 1 and consequently undergoes a mechanical expansion much higher than the thermal expansion which would be caused by that determined temperature increase, and a variation of its geometrical dimensions. As a matter of fact, under the stated conditions the conical base 3 has a radius "R" (greater than "Ro") and a height "h" (lower than "ho") and therefore a volume "V2". It can be demonstrated that the volume "V2" of the conical base 3 of the cavity is lower than the volume "V2o" of the same at the reference temperature "To".

It is obvious that an appropriate selection of the material used to implement the conical base 3 and an appropriate dimensioning of the same conical base 3, permit a decrease in the volume "V2" of the conical base 3 of the cavity equal to the increase in the volume "V1" of the cylindrical body 1 of the cavity, so as to obtain a microwave cavity whose volume, and consequently resonating frequency, is stabilized versus operating temperature variations.

A relationship to be used for the said dimensioning is given hereunder.

$$Ro - R = Ro\left\{\sqrt{\left[\frac{1+\beta(T-To)}{\cos\gamma o}\right]^2 - [1+\alpha(T-To)]^2} - \sqrt{\frac{1}{(\cos\gamma)^2} - 1}\right\}$$

where:

"ho-h" is the variation in height of the conical base 3,

"T-To" is the temperature variation,

"Ro" is the radius of the conical base 3 at the reference temperature "To",

"$\alpha$" is the coefficient of linear expansion of the cylindrical body 1

"$\beta$" is the coefficient of linear expansion of the conical base 3,

"$\gamma o$" is arctg ho/Ro and

"$\gamma$" is arctg h/R

By using the equation hereabove, conical bases 3 have been selected having a height "ho" ranging between 0.5 and 2 mm to implement cylindrical cavities whose resonating frequencies range between 15 and 20 GHz. It has been seen from experimental tests that a temperature variation of 25° C. with respect to the reference temperature "To" has resulted in a resonating frequency variation between 0.5 and 1 MHz.

It is obvious that any geometrical shape whose volume decreases while temperature increases, for instance a spherical bowl, can be selected as a basis for compensating the volume variations of the body of the cylindrical cavity. It is also obvious that the principle of compensating volume variations, and consequently resonating frequencies, versus temperature variations can be used with any type of metallic cavity, for instance rectangular or elliptical cavities.

From the decription given so far, the advantages of the microwave metallic cavity object of the present invention are clear. In particular they result: from the fact whereby a metallic cavity has been achieved whose resonating frequency is stabilized versus operating temperature variations; from the fact whereby materials having high values of coefficient of linear expansion can be used for its implementation, for instance aluminium, which is specially suited for that equipment in which weight plays a very important role, for instance equipment to be installed on board satellites. Thanks to its reduced specific weight; and from the fact whereby an improving factor of 10 is achieved in the stabilization of the resonating frequency with respect to the techniques known so far, the material used and the temperature variations been equal and; from the fact whereby materials like brass, copper or aluminium are much cheaper than invar, which results in cost reduction; from the fact whereby such materials, being easy to machine with machine tools, result in a further reduction in the production costs.

It is clear that many other modifications are possible to the described microwave metallic cavity that is the object of the present invention by those skilled in the art without departing from the scope of the present invention.

I claim:

1. A microwave metallic cavity comprising a hollow body, which encloses a first volume, and a base which in combination with said hollow body determine the total volume and the resonating frequency of said cavity, such first volume being increasing as long as operating temperature increases, characterized in that said base is made up of a geometrical shape which encloses a second volume, such second volume decreasing as long as operating temperature increases, wherein said hollow body has a thickness greater than the thickness of said base, and a coefficient of linear expansion greater than the coefficient of linear expansion of said base.

2. A microwave metallic cavity according to claim 1, characterized in that said hollow body (1) has a cylindrical shape.

3. A microwave metallic cavity according to claim 4, characterized in that said cylindrical body (1) has a cylindrical groove (8) in its internal lower section, in that said conical base (3) is inserted into the cylindrical groove (8) of said cylindrical body (1), in that a retaining ring (9) is positioned above the peripheral section of said conical base (3) and in that said retaining ring (9) and said conical base (3) are soldered onto the cylindrical body (1), so as to form one body.

4. A microwave metallic cavity according to claim 1, characterized in that said hollow body (1) has a rectangular shape.

5. A microwave metallic cavity according to claim 1, characterized in that said hollow body (1) has an elliptical shape.

6. A microwave metallic cavity according to claim 1, characterized in that said base (3) has a conical shape.

7. A microwave metallic cavity according to claim 1, characterized in that said base (3) has a spherical bowl shape.

8. A microwave metallic cavity according to claim 1, characterized in that said hollow body (1) is made of brass.

9. A microwave metallic cavity according to claim 1, characterized in that said hollow body (1) is made of copper.

10. A microwave metallic cavity according to claim 1, characterized in that said hollow body (1) is made of aluminium.

11. A microwave metallic cavity according to claim 1, characterized in that said base (3) is made of an iron-nickel alloy.

12. A microwave metallic cavity according to claim 11, characterized in that said iron-nickel alloy is invar.

13. A microwave metallic cavity according to claim 1, characterized in that said base (6) is mobile, so as to permit the adjustment of the total volume (V1+V2) and consequently of the resonating frequency of the same cavity.

14. A microwave metallic cavity according to claim 13, characterized in that the adjustment of said mobile base (6) is performed by means of an adjusting screw (5) firmly connected thereto.

* * * * *